US006555774B1

(12) United States Patent
Nielsen

(10) Patent No.: US 6,555,774 B1
(45) Date of Patent: Apr. 29, 2003

(54) LEVER KEYSWITCH

(75) Inventor: Kennard Nielsen, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 09/628,930

(22) Filed: Jul. 28, 2000

(51) Int. Cl.[7] ..... H01H 9/26
(52) U.S. Cl. ..... 200/343; 200/512
(58) Field of Search ..... 200/512–517, 200/341–345; 400/490, 491.2, 495, 495.1, 496

(56) References Cited

U.S. PATENT DOCUMENTS 3,749,859 A * 7/1973 Webb et al. ..... 200/5 R
3,842,230 A * 10/1974 Kashio et al. ..... 200/276
5,172,990 A * 12/1992 Weng ..... 400/490
5,481,074 A * 1/1996 English ..... 200/5 A
5,668,358 A * 9/1997 Wolf et al. ..... 200/5 A
5,669,723 A * 9/1997 Chang ..... 400/496
5,927,483 A * 7/1999 Yamada ..... 200/343
5,990,432 A * 11/1999 Kuroda ..... 200/343
6,060,672 A * 5/2000 Sugihara ..... 200/61.1
6,153,844 A * 11/2000 Hyono et al. ..... 200/5 A
6,169,256 B1 * 1/2001 Hanahara et al. ..... 200/5 A

* cited by examiner

*Primary Examiner*—Karl D. Easthom
*Assistant Examiner*—Lisa Klaus
(74) *Attorney, Agent, or Firm*—Banner & Witcoff, Ltd.

(57) ABSTRACT

A lever keyswitch for use primarily in electronic devices such as keyboards, mice, gaming devices, and the like includes a button portion secured to a base portion with a lever assembly that permits the button portion to move substantially linearly within its housing. Preferably, the lever assembly includes an elongate, resilient, U-shaped, lever extending from a base portion and an elongate, resilient, offset member extending from the center of the U-shaped lever to a button portion, which is encircled by the U-shaped lever. The lever and offset member work together to define a synthetic four-bar linkage, thereby allowing the button portion to move essentially linearly. More preferably, several keyswitches are integrally molded to a common base portion, forming a monolithic structure that may be quickly and easily manufactured and installed in the electronic device.

21 Claims, 3 Drawing Sheets

LEVER KEYSWITCH

TECHNICAL FIELD

This invention relates to a keyswitch for use primarily in electronic devices such as keyboards, mice, gaming devices, consumer electronics, and the like. In particular, the keyswitch includes a button portion that is secured to a base portion with a lever assembly such that the button portion moves substantially linearly within its housing. Preferably, several keyswitches are integrally molded to a common base portion, forming a monolithic structure that may be quickly and easily manufactured and installed in the electronic device.

BACKGROUND OF THE INVENTION

Keyswitches are commonly used to command a wide variety of functions. For example, electronic devices, such as keyboards, mice, and gaming devices typically have several keyswitches, or buttons, that a user depresses to activate a wide variety of functions. Modem keyboards not only include keyswitches for commanding individual letters, numbers, and symbols of a traditional typewriter, but also provide one or more additional keyswitches, usually aligned in an upper row of the keyboard, for allowing the user easy access and control of a particular application software, such as an Internet browser. It is desirable for keyswitches to move smoothly and independently from each other.

There are generally two types of keyswitches used on electronic devices. One type of keyswitch is an individually-molded component slideably received in an individually molded housing. These components are assembled onto a base and over an electronic switching device, such as a conventional resilient dome and conductive membrane assembly, or a contact switch. This type of keyswitch slides freely and essentially linearly within its housing providing smooth operation that is independent from other installed keyswitches.

However, because each keyswitch is individually molded and assembled and the typical installation includes multiple keyswitches, tooling costs of manufacturing are high. Moreover, considerable time and labor is required to install the required keyswitches. For example, a typical keyboard may contain 104 such key switches with one assembler responsible for installing between three to forty key switches. Depending on whether the key switch is unique, three unique keys may take the same amount of time to install as would forty identical keys. Accordingly, five to six assemblers may be needed to install these key switches on one keyboard.

Also, engineering adjustments to the keyswitches, such as to fine tune the height of the keyswitches with respect to the keyboard, or to improve the resistance characteristics of the keyswitches, require the design of each individual keyswitch assembly to be modified, significantly increasing the expenses associated with fine-tuning a product containing such keyswitches.

In light of the high tooling, manufacturing, and installation costs associated with individually molded keyswitches, a second, more economical, keyswitch assembly has emerged. This keyswitch assembly includes pivotally securing a button portion of the keyswitch to a base portion through an elongate lever arm. In particular, the button portion is positioned on the end of the lever arm extending from the base such that the button portion may be depressed. This type of keyswitch is commonly referred to in the industry as a lever keyswitch. Several lever keyswitches can be integrally molded to the base portion, thereby saving installation time and molding expenses by allowing all of the keyswitches to be manufactured in one mold, and installed at once by a single installer.

However, the button portions of such known lever keyswitches must move along the arcuate path defined by their respective lever arms. Accordingly, large tolerances in guide openings, or guide sleeves, are required for the button portions to move, thereby compromising their smooth operation. Moreover, in cases where several lever keyswitches are integrally molded together at a base portion, actuating one button portion can inadvertently move the other button portions.

Thus, despite the benefits of known keyswitches, there remains a need for a lever keyswitch that moves smoothly and substantially linearly, and that can also include multiple keyswitches that are integrally molded to a common base portion to form a monolithic structure that may be quickly, easily, and economically installed in an electronic device.

In addition to other benefits that will become apparent in the following disclosure, the present invention fulfills these needs.

SUMMARY OF THE INVENTION

The present invention is a lever keyswitch that includes a button portion secured to a base portion with a lever assembly that permits the button portion to move substantially linearly within a sleeve on a case of the electronic device. In particular, the lever assembly includes an elongate, resilient, and preferably U-shaped, lever extending from a base portion and an elongate, resilient, offset member extending from the center of the U-shaped lever to the button portion, which is encircled by the U-shaped lever. The lever and offset member work together to define a synthetic four bar linkage, thereby allowing the button portion to move essentially linearly within the sleeve.

Preferably, the base portion is an elongate spine, and a plurality of lever keyswitches, including their lever assemblies, are secured along that spine. More preferably, the spine and plurality of keyswitches, including their related button portions, levers and offset members are integrally molded of the same material using one mold, resulting in a monolithic structure that may be quickly and easily installed in the electronic device by a single installer.

DETAILED DESCRIPTION OF THE INVENTION

A plurality of lever keyswitches 10*a–g* having button portions 12*a–g* cantilevered from a base portion or spine 14, with respective lever assemblies 16*a–g* that permit each button portion 12*a–g* to move substantially linearly in the direction of arrow 18, preferably within a respective collar 20*a–g* on the case 22 of an electronic device, such as a keyboard 24, is disclosed in FIGS. 1A–6.

A. General Assembly

Figure 1A:
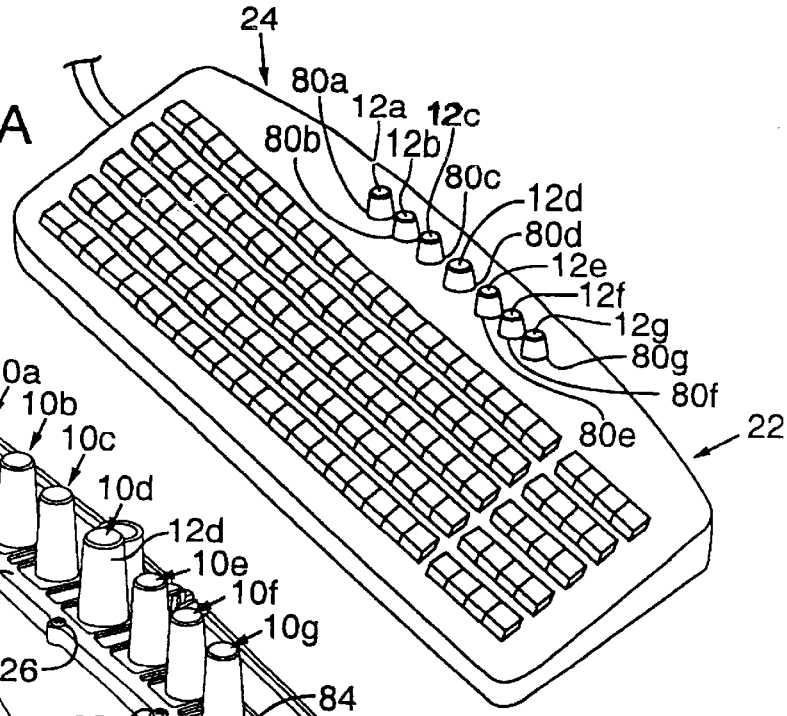
FIG. 1A is an isometric view of a computer keyboard having at least one lever keyswitch in accordance with a preferred embodiment of the present invention.
Figure 1B:
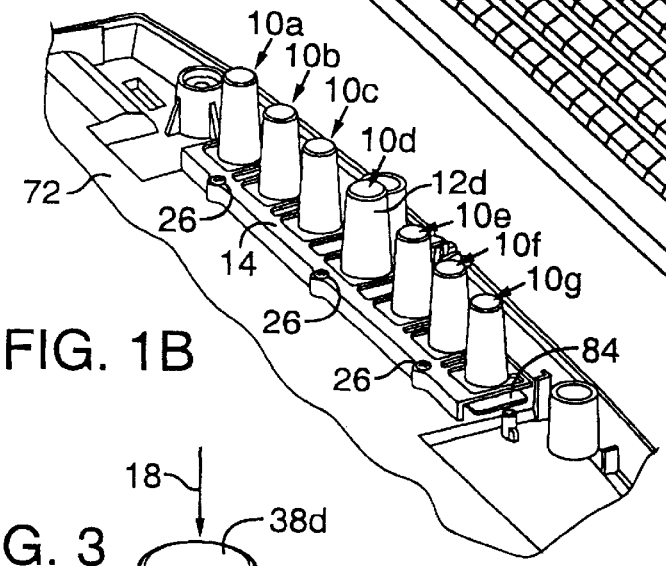
FIG. 1B is a fragmentary isometric view of the keyboard of FIG. 1A with its case upper section shell removed to show possible installation of a plurality of lever keyswitches in accordance with a preferred embodiment of the present invention.
Figure 2:
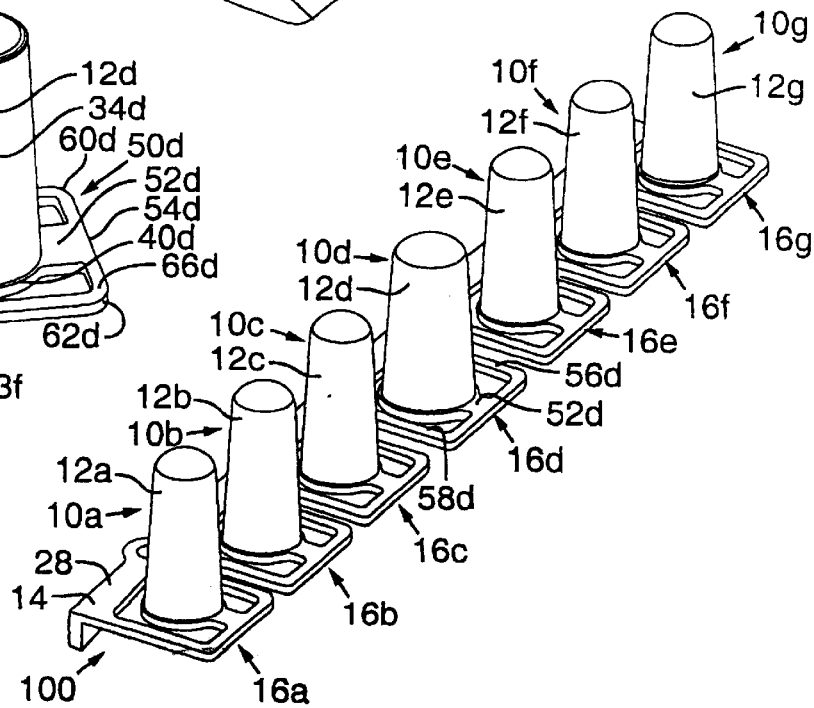
FIG. 2 is an enlarged isometric view of the plurality of lever keyswitches of FIG. 1B aligned along a base spine in accordance with a preferred embodiment of the present invention.
Figure 4:
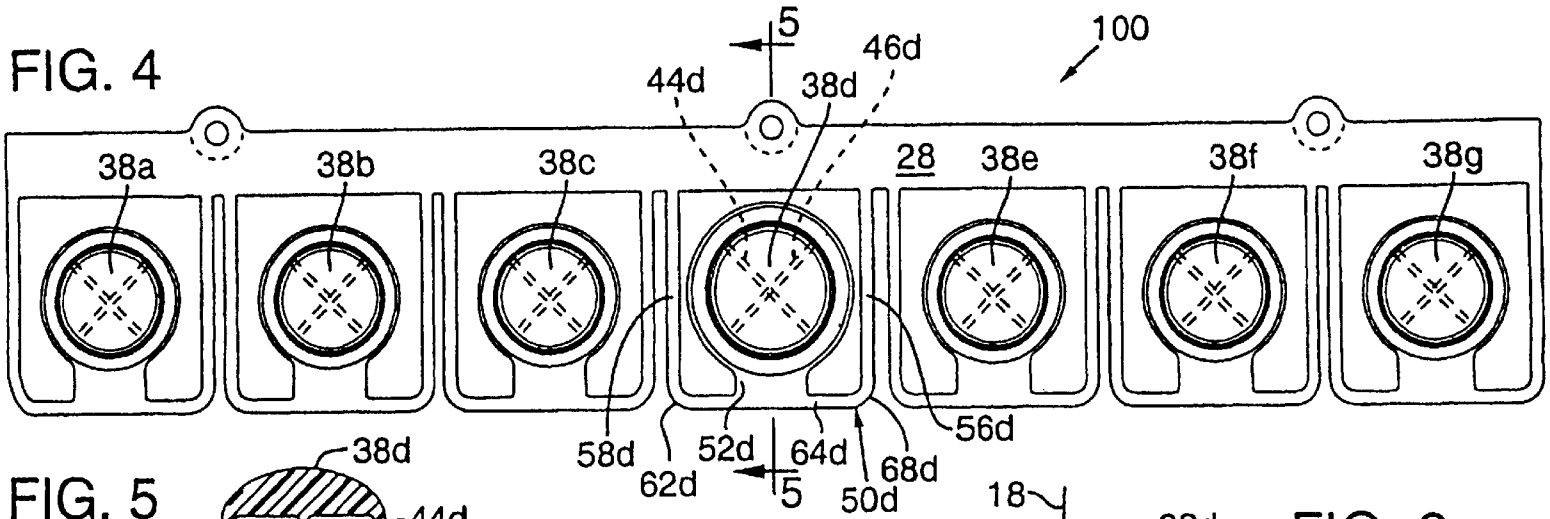
FIG. 4 is a top plan view of the plurality of lever keyswitches of FIG. 2.

It can be appreciated that several keyswitches 10*a–g* can be attached along the spine 14 as shown in FIGS. 1B, 2, and 4. All of the keyswitches 10*a–g* have similar components and are installed in a similar manner. Reference numbers for similar components between each keyswitch 10*a–g* share the same number following by different letters denoting the particular keyswitch 10*a–g* to which they are attributed. To prevent undue repetition, only keyswitch 12*d* and its components are discussed in specific detail below.

Figure 3:
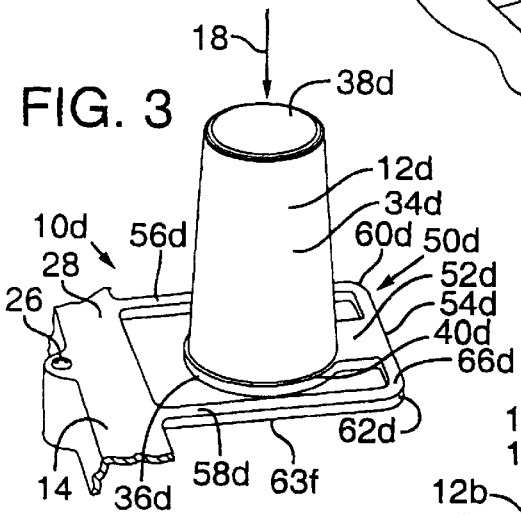
FIG. 3 is an enlarged isometric view of a lever keyswitch of FIG. 2.
Figure 5:
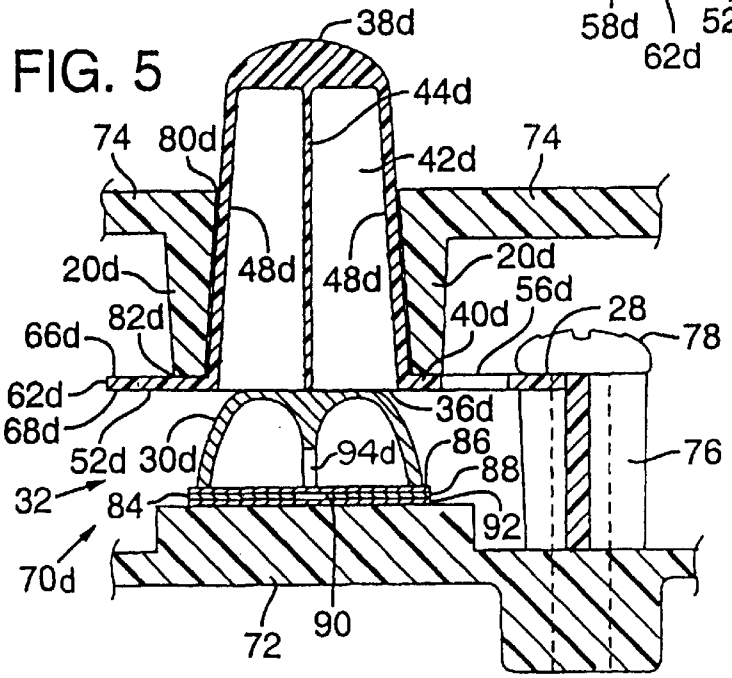
FIG. 5 is an enlarged cross sectional view taken along line 5—5 of FIG. 4 showing a lever keyswitch in its neutral position.
Figure 6:
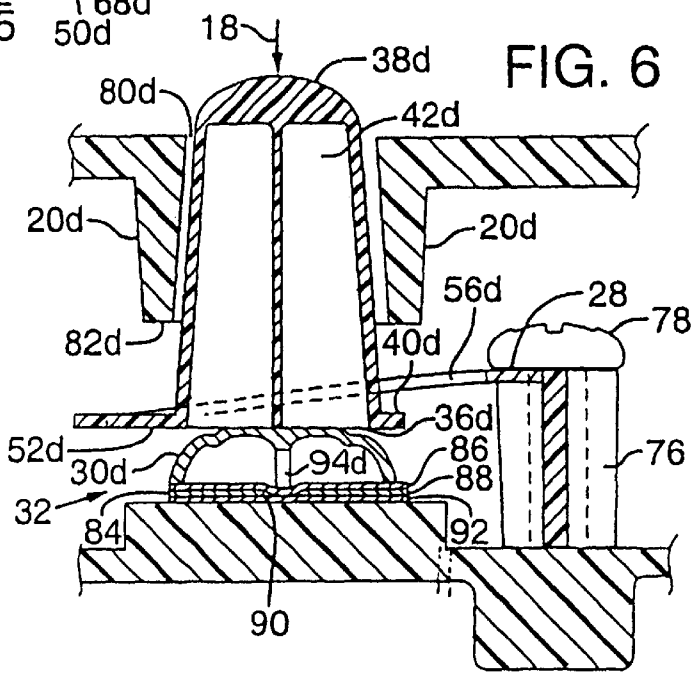
FIG. 6 is the cross sectional view of FIG. 5 showing a possible deflection of the lever keyswitch from its neutral position.

In particular and as best shown in FIGS. 2–4, the base portion of keyswitch 12*d* is preferably an elongate spine 14 molded of a strong material and includes mounting holes 26 for securing the base portion to the case 22 of the electronic device 24. More preferably, the spine 14 has a planar top surface 28 and a cross-sectional shape, such as the L-shaped cross-section as shown, that minimizes deflection of the spine 14 along its longitudinal length and supports the button portion 12*d* and lever.assembly 16*d* above conventional actuation devices, such as a conventional contact switch (not shown) or a resilient dome 30*d* and conductive membrane assembly switch 32 as shown in FIGS. 1B, 5 and 6.

The button portion 12*d* is preferably a molded, elongate, hollow-cored, slightly tapered shaft having an aesthetically pleasing, generally smooth, outer surface 34*d*, a generally circular cross-section, a substantially planar bottom surface 36*d*, and a top surface 38*d*. Preferably, the bottom surface 36*d* of the button portion 12*d* is parallel to the top surface 28 of the spine 14. More preferably, these surfaces 36*d* & 28 are on substantially the same plane, and a generally planar lip 40*d* extends around the outer surface 34*d* of the bottom portion of the button portion 12*d* as best shown in FIGS. 3 & 5.

In order to reduce the amount of material used, but still provide a strong button portion 12*d*, the hollow core 42*d* of the button portion 12*d* is open at the bottom surface 36*d* and includes a pair of orthogonally-aligned planar support panels 44*d*, 46*d* intersecting the longitudinal centerline of the button portion and extending between the internal walls 48*d* of the button portion 12*d*.

The lever assembly 16*d* connects the button portion 12*d* to the spine 14. Preferably, lever assembly 16*d* includes an elongate, resilient U-shaped lever 50*d* extending from the spine 14, and an elongate, resilient offset member 52*d* extending from the center 54*d* of the U-shaped lever 50*d* to the button portion 12*d*. The lever 50*d* includes a pair of parallel arms 56*d*, 58*d*, respectively, extending perpendicularly from the spine 14, and joined together at their distal ends 60*d*, 62*d*, respectively, by cross arm 64*d*. Preferably, the lever 50*d* and offset member 52*d* have essentially planar upper and lower surfaces 66*d*, 68*d*, respectively, aligned parallel to the top surface 28 of the spine 14, defining a neutral position 70*d* of the button portion 12*d* when the lever 50*d* and offset member 52*d* are so aligned. The lever 50*d* and offset member 52*d* are sized and shaped to deflect in a direction perpendicular to this plane. More preferably, the button portion 12*d* is encircled by the U-shaped lever 50*d*, and the lever 50*d* and offset member 52*d* are aligned substantially on the same plane as the bottom surface 36*d* of the button portion 12*d* as best shown in FIGS. 3 & 5.

Preferably, additional keyswitches 12*a–c* and 12*e–g*, having similar structures, are installed along the spine 14, and the electronic device 24 includes components for mounting and aligning the keyswitches 12*a–g* onto it. In particular, and as best shown in FIGS. 1A, 1B, and 5, the electronic device 24 includes a case 22 formed of a case lower section 72 and a case upper section 74 joined together. The case lower section 72 includes mounting portions 76 for allowing the spine 14 to be secured to it at mounting holes 26, such as extending mounting screws 78 (FIG. 5) through mounting holes 26 and securing them to mounting portions 76 as shown in FIG. 5. The case upper section 74 includes recesses or openings 80*a–g* sized for slideably receiving the button portions 12*a–g*, respectively, of the lever keyswitches 10*a–g*.

Preferably, collar portions 20*a–g* (20*d* is shown in FIG. 5) having distal ends 82*a–g* (82*d* is shown in FIG. 5) and sized to slideably receive the tapered button portions 12*a–g* are secured to the case upper section 74. As best shown in FIG. 5, lips 40*a–g* (40*d* is shown) engage the distal end 82*a–g* (82*d* is shown) of the collars 20*a–g* (20*d* is shown) when the button portions 12*a–g* (12*d* is shown) are in their respective neutral positions, serving as a stop for the button portion 12*a–g* (12*d* is shown), and allowing designers to easily adjust the height the button portion extends above the case upper section 74 simply by adjusting the length of collars 20*a–g* (12*d* is shown).

Preferably, the button portions 12*a–g* (12*d* is shown) are biased to its neutral position with known devices, such as supporting the button portion with a resilient dome 30*d* above a switching device as shown in FIG. 5. More preferably, the switching device includes a three-layer membrane 84 having electrically conductive upper and lower portions 86, 92 respectively, and an electrically-insulated central portion 88 with an opening 90. The resilient dome 30*d* is preferably constructed of rubber and includes an engaging shaft 94*d* aligned adjacent and substantially perpendicularly to the membrane 84 above the opening 90 in the central portion 88 of the membrane 84 such that deflection of the dome 30*d* urges the shaft 94*d* to move the upper portion 86 of the membrane 84 into contact with the Lower portion 92 of the membrane 84 thereby closing an electrical circuit. When the dome 30*d* returns to its un-deflected position (as shown in FIG. 5), the engaging shaft 94*d* disengages the membrane 84, causing the upper and lower portions 86, 92, respectively, to disengage, thereby opening the electrical circuit.

Figure 7:
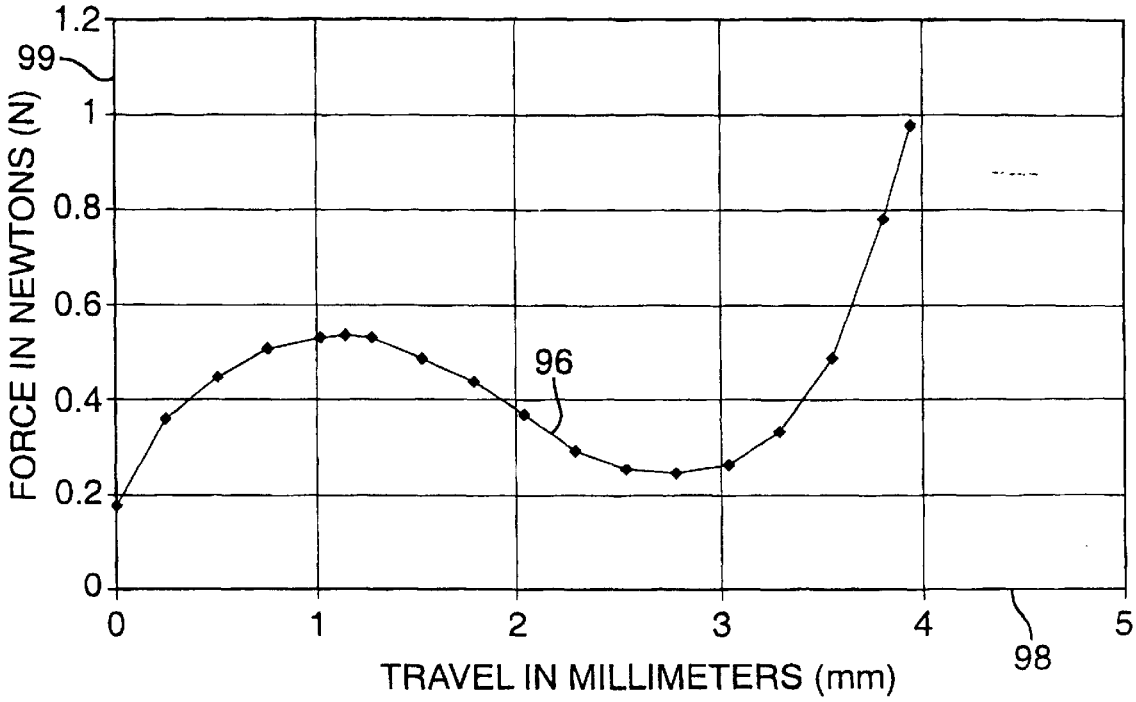
FIG. 7 is a force versus deflection curve showing a desirable performance characteristic of the lever keyswitch in accordance with a preferred embodiment of the present invention.

The resilient dome 30*d* and components of the lever assembly 6*d* are sized and shaped to provide optimal performance, or feel, to the user. One preferred performance characteristic of the lever keyswitch 10*d* is shown in the force verses distance traveled performance curve 96 of FIG. 7. The x-axis 98 of this chart denotes distance the button portion 12*d* is deflected from its neutral position 70*d*. The y-axis 99 denotes the amount of force felt by the user depressing the button portion 12*d*. As shown in FIG. 7, the force felt by the user depressing the button portion 12*d* increases as the button portion 12*d* is initially deflected. Then, the amount of force gradually reduces as the button portion travels along its range of motion, until it significantly increases toward the end of the button portion's travel.

B. Preferred Method of Manufacturing

Preferably, the keyswitches 10*a–g*, including their respective button portions 12*a–g* and lever assemblies 16*a–g* are integrally molded with the spine 14 using conventional molding methods. More preferably, these components are integrally molded using one durable, but resilient, material in one mold, resulting in the monolithic structure 100 best shown in FIG. 2. One known preferred material for use when molding this monolithic structure is Acrylonitrile-Butadiene-Styrene ("ABS") polymer. One known brand of such ABS polymer is sold by BASF Corporation under the trademark Terluran GP 35.

C. Installation of the Lever Keyswitch

The monolithic structure 100 containing a plurality of lever keyswitches 10*a–g* is easily installed on the case lower section 72, which preferably contains a plurality of known electronic switching devices, such as conventional resilient domes 30*a–g* over a membrane 84 (FIG. 5) or conventional contact switches (not shown) that have been previously installed using conventional methods. In particular, one installer aligns and positions the mounting holes 26 of the spine 14 over the mounting portions 76 on the case lower section 72, and secures the spine 14 to mounting portions 76, preferably with mounting screws 78 (FIG. 5) extending through the mounting holes 26 into the mounting portion 76 as best shown in FIG. 5.

As a result, each lever keyswitch 10*a–g* is cantilevered over an electronic switching device, such as a corresponding resilient dome 30*a–g* and membrane 84 assembly. The case upper section 74 is then secured to the case lower section 72 with the button portions 12*a–g* of the lever keyswitches 10*a–g* extending through their corresponding recesses or openings 80 in the case upper section 74, securing the lever keyswitches 10*a–g* in place.

D. Operation of the Lever Keyswitch

The lever 50*d* and offset member 52*d* of the lever assembly 16*d* work together to define a synthetic four-bar linkage, thereby allowing the button portion 12*d* to move essentially linearly within the collar 20*d* as best shown in FIGS. 5 and 6. In particular, with the button portion 12*d* in its neutral position 70*d* as shown in FIG. 5, the top surface 38*d* of the button portion 12*d* extends above the surface of the case upper section 74. The bottom surface 36*d* of the button portion 12*d* rests on a resilient dome 30*d*. Within the resilient dome 30*d* is the engaging shaft 94*d* for engaging the conductive portions of the membrane 84. In this position, the pair of parallel arms 56*d*, 58*d* extending perpendicularly from the spine 14 and cross arm 64*d* of the U-shaped lever 50*d* and the offset member 52*d* are aligned substantially on the same plane.

When a user depresses the button portion 12*d* of lever keyswitch 10*d*, the button portion 12*d* is urged downward along collar 20*d* as shown in FIG. 6. The pair of parallel arms 56*d*, 58*d* deflect along an arcuate path like a conventional lever as shown, while the offset member 52 remains substantially parallel with the plane of the bottom surface of the button portion 12*d*. The deflection of the button portion 12*d* deflects the resilient dome 30*d*, causing the engaging shaft 94*d* to engage the membrane 84 as previously described, thereby closing a circuit. When the button portion 12*d* is released, the resilient dome 30*d* urges the button portion 12*d* to return to its neutral position 70*d*, disengaging the engaging shaft 94*d* from the membrane 84, thereby opening the circuit.

As a result, the button portion 12*d* moves substantially linearly within the collar 20*d* in the direction of arrow 18, providing smooth, independent operation, similar to an individually molded and assembled keyswitch. However, a plurality of keyswitches 10*a–g* can be integrally molded and assembled with minimal materials, tooling, and installers, like a traditional lever keyswitch. Moreover, because the spine 14 remains substantially rigid along its length, movement of one keyswitch will not inadvertently cause other keyswitches along the spine to move. Also, the shape and dimensions of the lever assembly's components can be readily modified to optimize the performance characteristics of the keyswitch, such as to optimize the force verses deflection characteristics of the keyswitch.

In view of the wide variety of embodiments to which the principles of the invention can be applied, it should be apparent that the detailed description of the invention is illustrative only and should not be taken as limiting the scope of the invention. For example, the shape of the button portions, spine, and lever assembly components can be readily modified from the shapes described without compromising the function of these components. Similarly, any type of device, including resilient domes, springs, and the like, can be used to bias the button portion to its neutral position. Also, the lever keyswitch will work equally well to actuate any type of command detection devices used in the industry, including any type of transducer such as Hall effect sensing devices, LDVT transducers and LED-based transducers. Moreover, the lever keyswitch can be used on any electronic device, such as keyboards, mice, input devices, gaming devices, and other consumer electronic devices. Accordingly, the claimed invention includes all such modifications as may come within the scope of the following claims and equivalents thereto.

What is claimed is:

1. A lever keyswitch for use on an electronic device, said keyswitch including:

a base portion attachable to the electronic device;

a button; and a resilient lever assembly cantilevering said button from said base portion, said lever assembly including an elongate, resilient lever extending from said base portion and having a distal end, and an elongate, resilient offset member extending from said distal end to said button, wherein said button is positioned between said base portion and said distal end, a distal side of said button closest to said distal end is spaced from said distal end, and said lever and said offset member are deflected in opposite angular directions upon pressing of said button, such that movement of said button upon pressing is substantially linear.

2. The lever keyswitch of claim 1, wherein said elongate lever is substantially U-shaped, and said button is encircled by said lever.

3. The lever keyswitch of claim 1, wherein said elongate lever includes a pair of parallel arms spaced apart by a predetermined distance and joined together by a cross arm near said distal end, and wherein said offset member extends from said cross arm and said button is positioned within the area defined by said base portion, parallel arms and cross arm.

4. The lever keyswitch of claim 3, wherein said parallel arms, cross arm and offset member have upper surfaces, said button portion has a bottom surface, and said upper surfaces and bottom surface are parallel to each other.

5. The lever keyswitch of claim 4, wherein said upper surfaces are on substantially the same plane.

6. A keyswitch assembly for use on an electronic device, the keyswitch assembly comprising:

a base portion attachable to the electronic device;

a plurality of buttons connected to said base portion; and a plurality of resilient lever assemblies cantilevering respective ones of said plurality of buttons from said base portion, each of said plurality of lever assemblies including an elongate, resilient lever extending from said base portion and having a distal end, and an elongate, resilient offset member extending from said distal end to a respective button, wherein said respective button is positioned between said base portion and said distal end, a distal side of said button closest to said distal end is spaced from said distal end, and said lever and said offset member are deflected in opposite angular directions upon pressing of said respective button, such that movement of said respective button upon pressing is substantially linear.

7. The keyswitch assembly of claim 6, wherein said elongate lever is substantially U-shaped, and said respective button is encircled by said lever.

8. The keyswitch assembly of claim 6, wherein said elongate lever includes a pair of parallel arms spaced apart by a predetermined distance and joined together by a cross arm near said distal end, and wherein said offset member extends from said cross arm and said respective button is positioned within the area defined by said base portion, parallel arms and cross arm.

9. The keyswitch assembly of claim 8, wherein said parallel arms, cross arm and offset member have upper surfaces, said respective button has a bottom surface, and said upper surfaces and bottom surface are parallel to each other.

10. The keyswitch assembly of claim 9, wherein said upper surfaces are on substantially the same plane.

11. The keyswitch assembly of claim 6, wherein said base portion is an elongate spine and said plurality of resilient lever assemblies are installed, each one at predetermined distances along said spine.

12. The keyswitch assembly of claim 11, wherein said spine and said plurality of resilient lever assemblies are a monolithic structure.

13. An electronic device, comprising:

a case defining a shell of the electronic device, said case having an opening;

a base portion connected to said case;

a button slideably positioned in said opening; and a resilient lever assembly cantilevering said button from said base portion, said lever assembly including an elongate, resilient lever extending from said base portion and having a distal end, and an elongate, resilient offset member extending from said distal end, to said button, wherein said button is positioned between said base portion and said distal end, a distal side of said button closest to said distal end is spaced from said distal end, and said lever and said offset member are deflected in opposite angular directions upon pressing of said, button, such that movement of said button upon pressing is substantially linear.

14. The electronic device claim 13, wherein said elongate lever is substantially U-shaped, and said button is encircled by said lever.

15. The electron device of claim 13, wherein said elongate lever includes a pair of parallel arms spaced apart by a predetermined distance and joined together by a cross arm near said distal end, and wherein said offset member extends from said cross arm and said button is positioned within the area defined by said base portion, parallel arms and cross arm.

16. The electronic device of claim 13, wherein the case has a collar around said opening, said collar having a distal end and said button portion having a lip for engaging said distal end of said collar.

17. The electronic device of claim 16, wherein a neutral position of said button with respect to said case is defined when said lip engages the distal end of said collar, and said resilient lever assembly is biased to said neutral position.

18. The electronic device of claim 13, wherein said base portion is an elongate spine and a plurality of said resilient lever assemblies are installed, each one at predetermined distances along said spine.

19. The electronic device of claim 18, wherein said spine and said plurality of resilient lever assemblies are a monolithic structure.

20. The electronic device of claim 18, further comprising a plurality of buttons, and each of said resilient lever assemblies cantilevering a respective one of said plurality of buttons.

21. The electronic device of claim 20, wherein at least one of said plurality of buttons is larger than another of said plurality of buttons.

* * * * *

UNITED STATES PATENT AND TRADEMARK OFFICE

CERTIFICATE OF CORRECTION

PATENT NO. : 6,555,774 B1
DATED : April 29, 2003
INVENTOR(S) : Kennard Nielson

It is certified that error appears in the above-identified patent and that said Letters Patent is hereby corrected as shown below:

Column 1,
Line 21, “Modem” has been replaced with -- Modern --;

Column 2,
Line 35, “four bar” has been replaced with -- four-bar --;

Column 3,
Line 36, “lever.assembly” has been replaced with -- lever assembly --;

Column 8,
Line 18, “electron” has been replaced with -- electronic --.

Signed and Sealed this

Second Day of December, 2003

JAMES E. ROGAN
*Director of the United States Patent and Trademark Office*